US009737753B2

(12) United States Patent
Chuang

(10) Patent No.: US 9,737,753 B2
(45) **Date of Patent: *Aug. 22, 2017**

(54) STEPPER

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/931,831

(22) Filed: Nov. 3, 2015

(65) Prior Publication Data

US 2016/0271439 A1 Sep. 22, 2016

(30) Foreign Application Priority Data

Mar. 20, 2015 (TW) ..... 104204231 U

(51) Int. Cl.

| | |
|---|---|
| ***A63B 22/04*** | (2006.01) |
| ***A63B 22/00*** | (2006.01) |
| ***A63B 21/02*** | (2006.01) |
| ***A63B 21/04*** | (2006.01) |
| ***A63B 21/055*** | (2006.01) |

(52) U.S. Cl.

CPC ..... *A63B 22/0012* (2013.01); *A63B 21/023* (2013.01); *A63B 21/0407* (2013.01); *A63B 21/055* (2013.01); *A63B 22/0056* (2013.01); *A63B 22/0061* (2013.01)

(58) Field of Classification Search

CPC ..... A63B 22/0023; A63B 22/0048; A63B 22/0056; A63B 22/0058; A63B 22/0064; A63B 22/0066; A63B 22/0069; A63B 22/16; A63B 2022/0025; A63B 2022/0033; A63B 2022/0074; A63B 23/0429; A63B 23/0458; A63B 2023/0447; A63B 2023/0452; A63B 23/08; A63B 23/085; A63B 23/10; A63B 21/02; A63B 21/023; A63B 21/0407; A63B 21/0435; A63B 21/055

USPC ..... 482/52, 53, 79, 80

See application file for complete search history.

(56) References Cited

U.S. PATENT DOCUMENTS

| | | | | |
|---|---|---|---|---|
| 4,563,001 A * | 1/1986 | Terauds | ..... | A63B 21/00072 482/112 |
| 6,315,697 B1 * | 11/2001 | Chen | ..... | A63B 22/0056 482/146 |
| D773,567 S * | 12/2016 | Chuang | ..... | D21/668 |
| 2004/0048721 A1 * | 3/2004 | Chou | ..... | A63B 22/0056 482/52 |

(Continued)

*Primary Examiner* — Loan H Thanh
*Assistant Examiner* — Gregory Winter
(74) *Attorney, Agent, or Firm* — CKC & Partners Co., Ltd.

(57) ABSTRACT

A stepper includes a base, a linking rod, two pedals and two adjusting mechanisms. The linking rod is disposed on the base and includes two ends that are concentrically rotated with each other. Each of the adjusting mechanism includes a blocking member and a blocking block. The blocking member includes a first blocking surface. The blocking block includes at least one second blocking surface resisting the first blocking surface of the blocking member. When one of the pedals is lowered along a gravity direction, one of the first blocking surfaces and one of the second blocking surfaces are inclined along the gravity direction to link up one end of the linking rod thereby concentrically rotating the other end of the linking rod, and the other first blocking surface is resisted by the other second blocking surface thereby swinging and raising the other pedal.

11 Claims, 14 Drawing Sheets

(56) References Cited

U.S. PATENT DOCUMENTS

| | | | | |
|---|---|---|---|---|
| 2005/0049116 | A1* | 3/2005 | Huang | A63B 22/0064 482/51 |
| 2005/0272563 | A1* | 12/2005 | Liang | A63B 21/00 482/53 |
| 2006/0035756 | A1* | 2/2006 | Chen | A63B 22/0069 482/53 |
| 2006/0270526 | A1* | 11/2006 | Jyr | A63B 22/0056 482/53 |
| 2007/0254782 | A1* | 11/2007 | Chen | A63B 22/0056 482/53 |
| 2008/0194387 | A1* | 8/2008 | Chuang | A63B 21/0552 482/52 |
| 2011/0111927 | A1* | 5/2011 | Kim | A63B 21/00192 482/52 |
| 2016/0151662 | A1* | 6/2016 | Lo | A63B 21/026 482/52 |

* cited by examiner

STEPPER

RELATED APPLICATIONS

The application claims priority to Taiwan Application Serial Number 104204231, filed on Mar. 20, 2015, which is herein incorporated by reference.

BACKGROUND

Technical Field

The present disclosure relates to a stepper. More particularly, the present disclosure relates to a stepper that can swing left and right by raising or lowering the pedals.

Description of Related Art

A stepper is one kind of fitness equipment. The stepper can simulate behaviors while climbing the stairs by swinging the pedals thereof, thereby training muscle of the left and the right foot. Now, the pedal of the stepper can not only swing up and down, but also can rotate, thus waist strength can be enhanced, and sense of balance of a human body can also be increased.

However, a linking-up mechanism of a conventional stepper are usually complicated. For example, the conventional linking-up mechanism is commonly equipped with swingable lever under the left and the right pedal. By the lever principle, when one pedal is lowered by the gravity and resists one end of the lever, the other pedal is pushed by the other end of the lever and is raised. Another kind of linking-up mechanism is equipped with a V-shape swing arm under the left and the right pedal, and the V-shape swing arm can rotate around a circle center. In this kind of linking-up mechanism, since the diameter is equal in length and the angle is fixed, when one pedal is lowered by the gravity and resists one end of the V-shape swing arm, the other of the pedal is pushed by the other end of the V-shape swing arm and is raised.

Furthermore, in a conventional stepper, the rotating and the swinging of the left and the right pedals are performed by pivotally disposing the two pedals on a support by an axis, therefore the pedals can and rotate relative to the support.

However, in the linking-up mechanism of the conventional stepper, the working paths of the left and the right pedal sere fixed, thus the pedal stroke and the swinging angle cannot be adjusted to meet different users' requirements. Furthermore, the lowering, raising and swinging of the pedals are achieved through complicated linking-up mechanisms, thus the cost is high.

SUMMARY

According to one aspect of the present disclosure, a stepper is provided. The stepper includes a base, a linking rod, two pedals and two adjusting mechanisms. The linking rod is disposed on the base, and the linking rod includes two ends that are concentrically rotated with each other. Each of the pedals includes a pedal member and a pedal arm. The pedal arm is connected to the pedal member, and the pedal arm is pivotally connected with one end of the linking rod for reciprocately raising or lowering the pedal member. Each of the adjusting mechanism includes a blocking member and a blocking block. The blocking member is disposed on the pedal arm, and the blocking member includes a first blocking surface. The blocking block is apart from the linking rod by a pre-determined distance. The blocking block includes at least one second blocking surface resisting the first blocking surface of the blocking member. When one of the pedals is lowered along a gravity direction, one of the first blocking surfaces and one of the second blocking surfaces are inclined along the gravity direction to link up one end of the linking rod thereby concentrically rotating the other end of the linking rod, and the other first blocking surface is resisted by the other second blocking surface thereby swinging and raising the other pedal.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
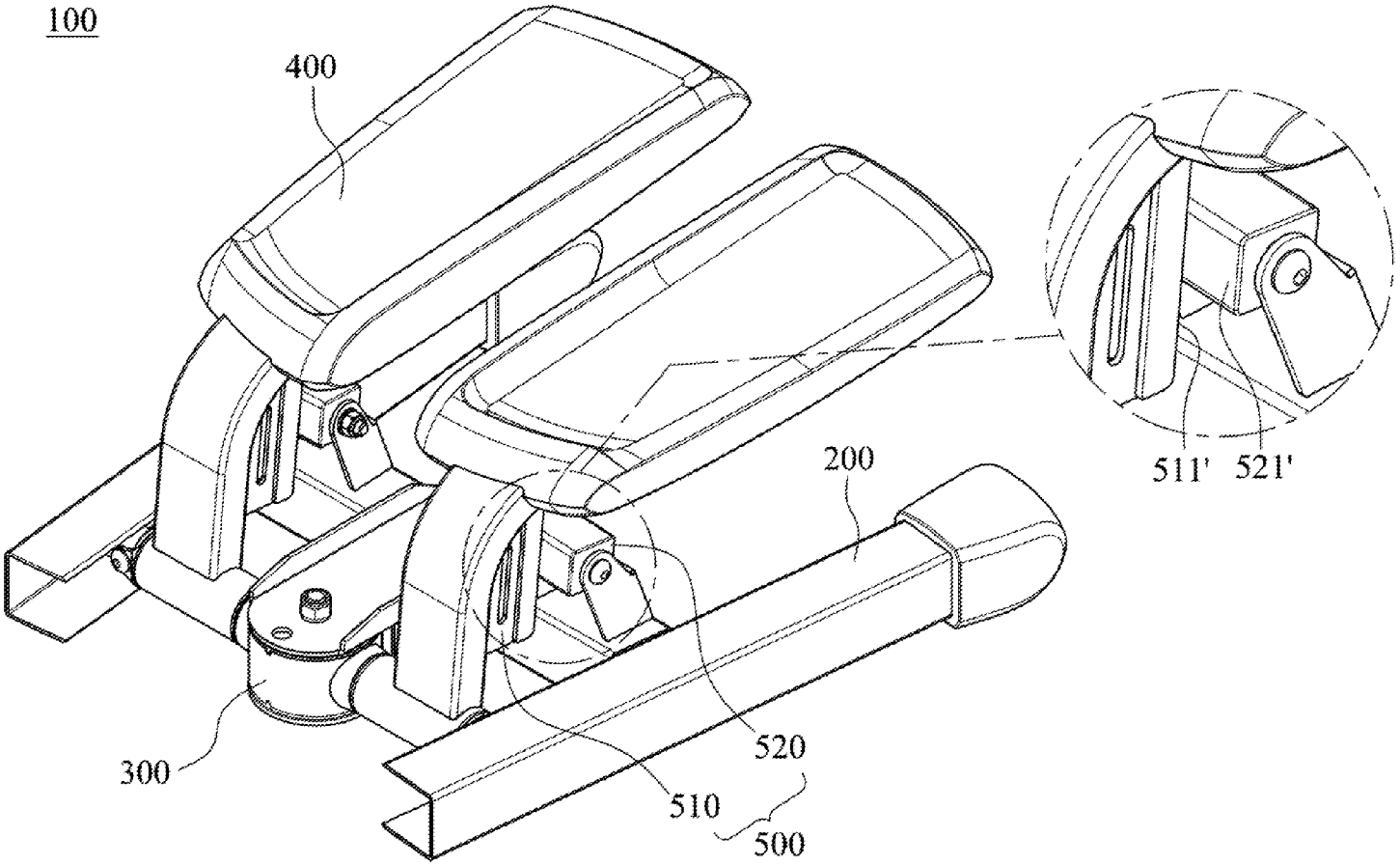
FIG. 1 is a three-dimensional view showing a stepper according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

The present disclosure provides a stepper that avoids using complicated linking-up mechanism, and is capable of adjusting the pedal stroke and the swing angle in accordance with different users' requirements.

Figure 2:
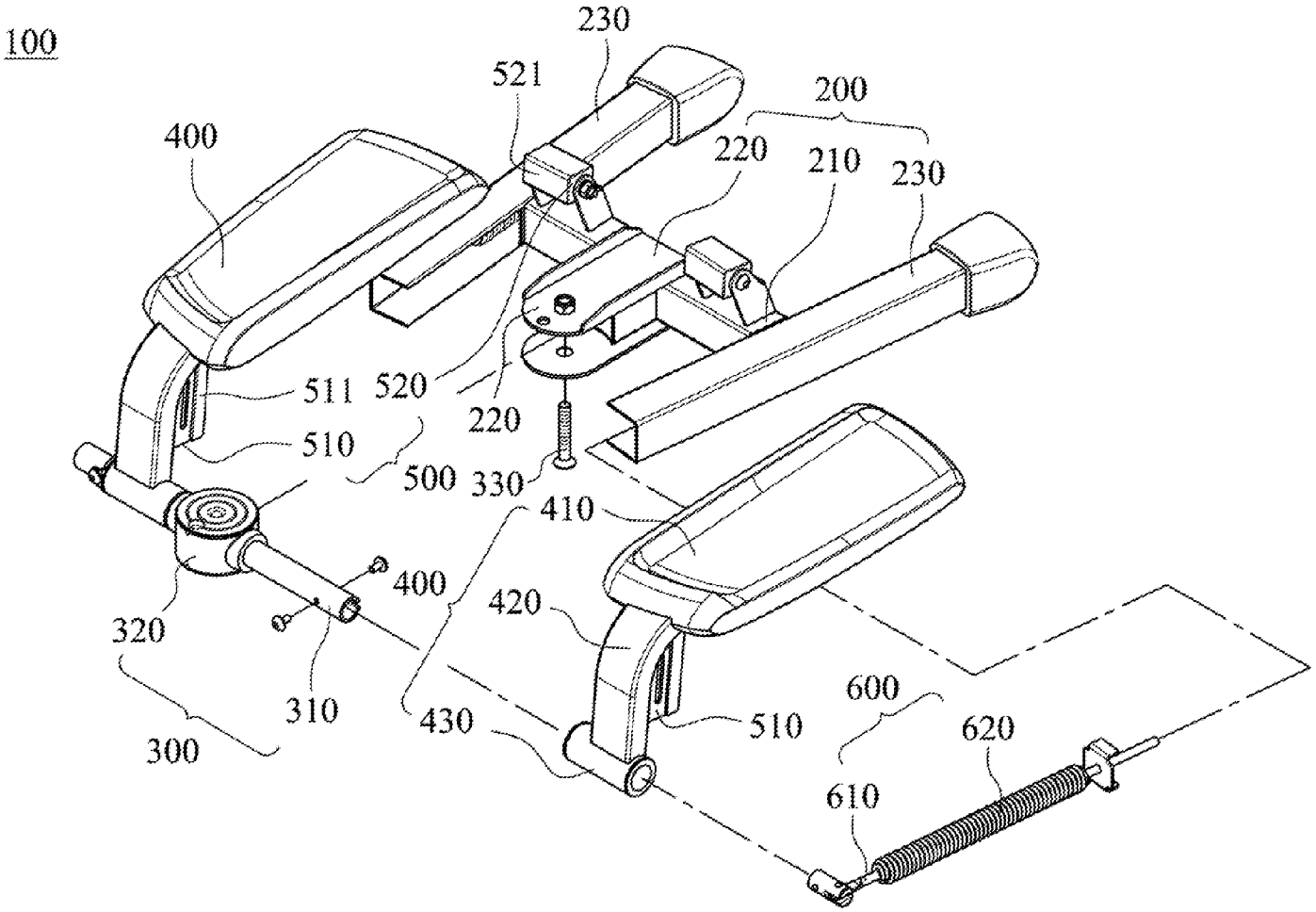
FIG. 2 is an exploded view of the stepper of FIG. 1.
Figure 3:
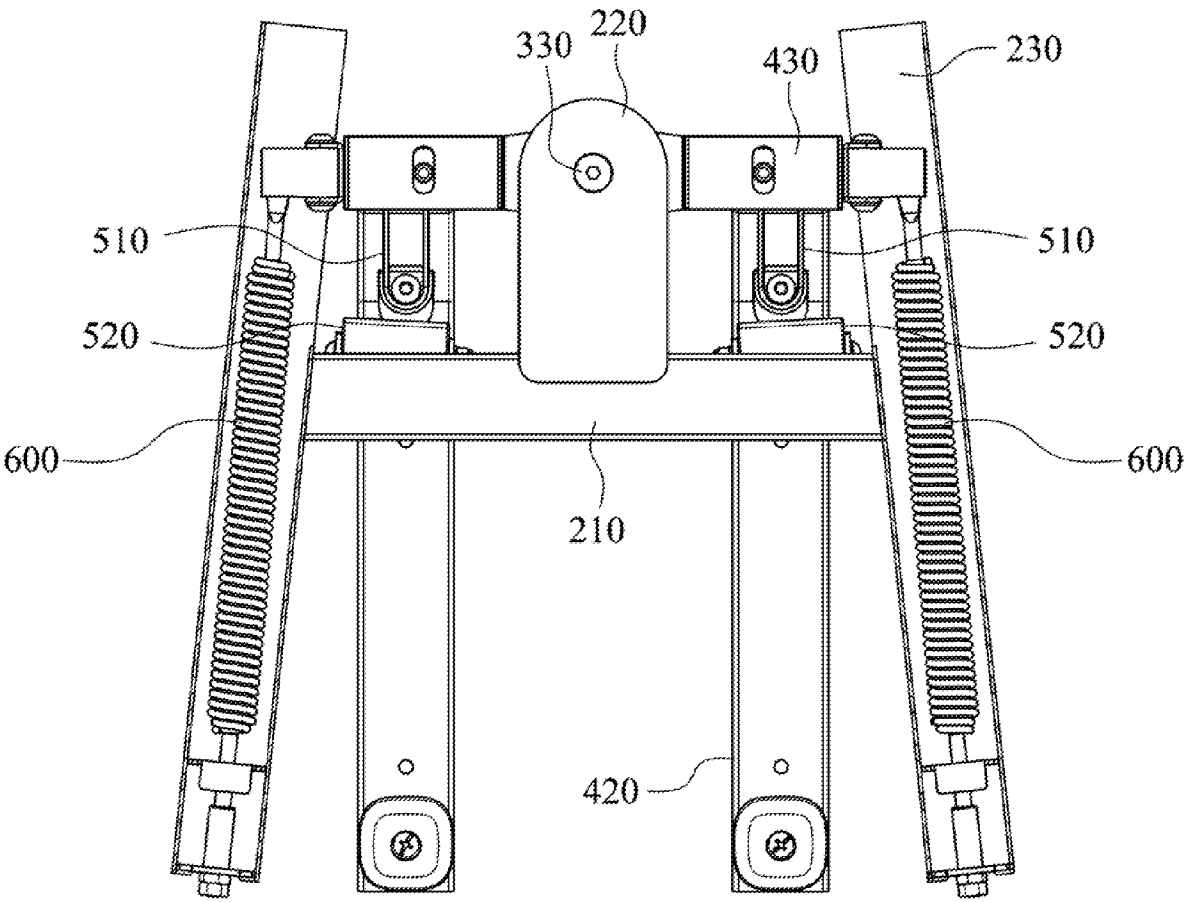
FIG. 3 is a bottom side view of the stepper of FIG. 2.

FIG. 1 is a three-dimensional view showing a stepper 100 according to one embodiment of the present disclosure; FIG. 2 is an exploded view of the stepper 100 of FIG. 1; and FIG. 3 is a bottom side view of the stepper 100 of FIG. 2. The stepper 100 includes a base 200, a linking rod 300, two pedals 400, two adjusting mechanisms 500 and two recovering mechanisms 600.

The base 200 is stably placed on a plane. The base 200 includes a central portion 210, an extension portion 220 and two side portions 230. The extension portion 200 is extended vertically and outwardly from the central portion 210. The two side portions 230 are connected to two ends of the central portion 210 respectively, and the two side portions 230 are hollow and are arranged in a shape of splayed arch.

The linking rod 300 is pivotally disposed on the base 200, and it has two ends 310 that are concentrically rotated with each other and a circle center portion 320. The circle center portion 320 is located at the center of the linking rod 300, and the center portion 320 is pivotally connected to an outer end of the extension portion 220 by an axis 330, thereby rotating the linking rod 300 relative to the base 200.

Each of the pedals 400 includes a pedal member 410, a pedal arm 420 and a pivoting portion 430. The pedal member 410 is used for stamping. The pedal arm 420 is "L" shaped and is connected to the pedal member 410. The pivoting portion 430 is integrally connected to the pedal arm 420, and each of the pivoting portions 430 is pivotally connected to two ends 310 of the linking rod 300, therefore the pedal arm 420 can be rotated relative to the linking rod 300 for reciprocately raising or lowering the pedal member 410.

Each of the adjusting mechanism 500 includes a blocking member 510 and a blocking block 520. The blocking member 510 is disposed on the pedal arm 420 and includes a first blocking surface 511. The first blocking surface 511 can be an arc surface 511' and can be made from elastic material. Two blocking blocks 520 are apart from the linking 300 by a pre-determined distance. The blocking block 520 is disposed on the central portion 210. The blocking block 520 includes at least one second blocking surfaces 521 for rotatably resisting the first blocking surface 511 of the blocking member 510. In the embodiment, the blocking block 520 includes four second blocking surfaces 521, and each of the second blocking surfaces 521 can be an arc surface 521'.

Each of the recovering mechanism 600 is located in the two side portions 230. Each of the recovering mechanism 600 is connected to two ends 310 of the linking rod 300 and the base 200. In this embodiment, the recovering mechanism 600 includes a connecting lever 610 and a tension spring 620. One end of the connecting lever 610 is connected to one end 310 of the linking rod 300; the other end of the connecting lever 610 is connected to the tension spring 620.

Figure 4A:
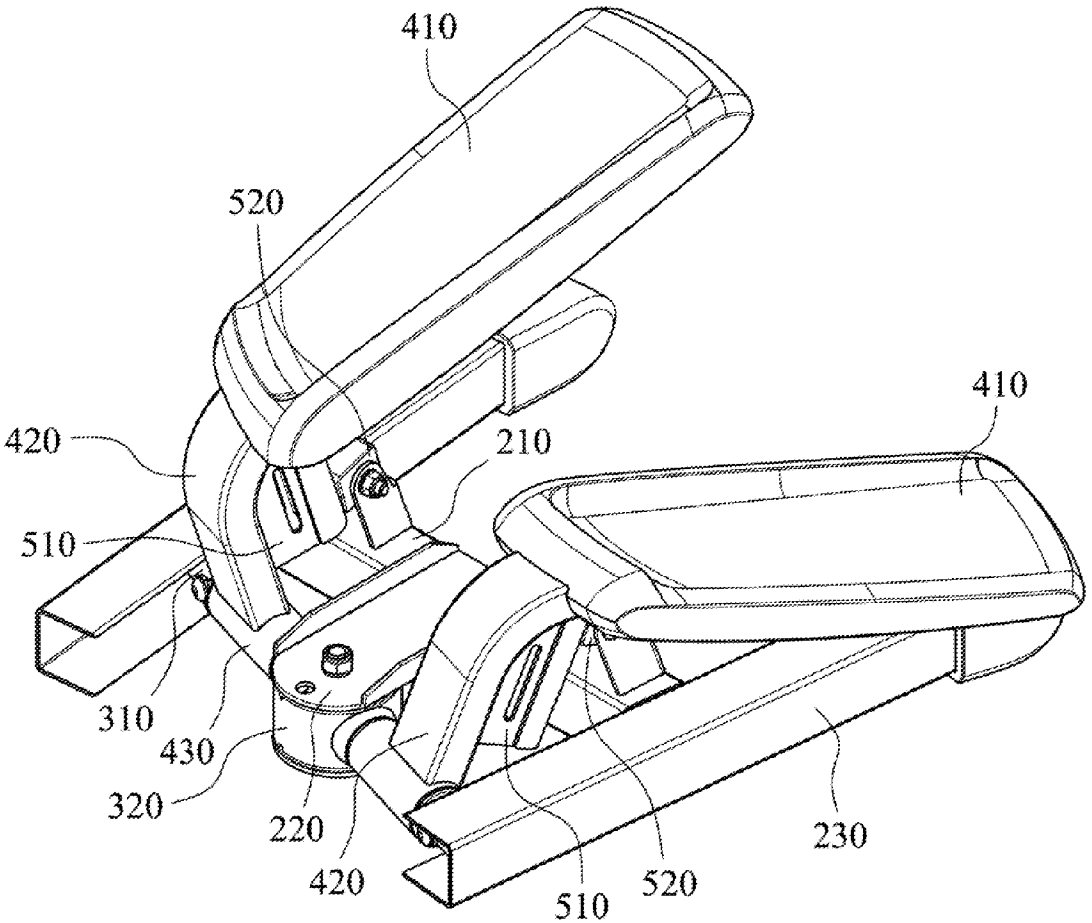
FIG. 4A is a schematic view showing an action of the stepper of FIG. 2.
Figure 4B:
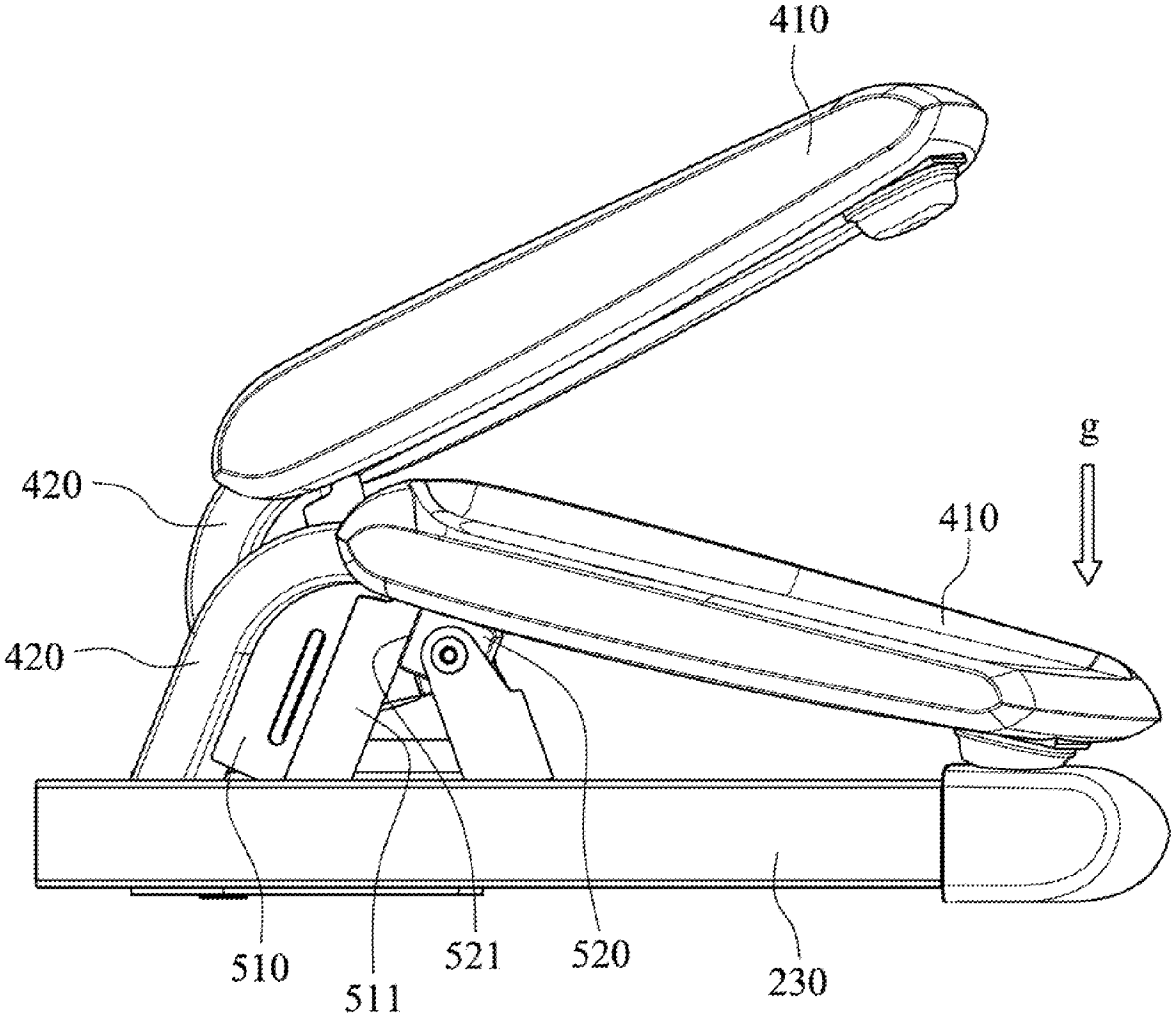
FIG. 4B is a schematic view showing an action of one side of the stepper of FIG. 4A.
Figure 4C:
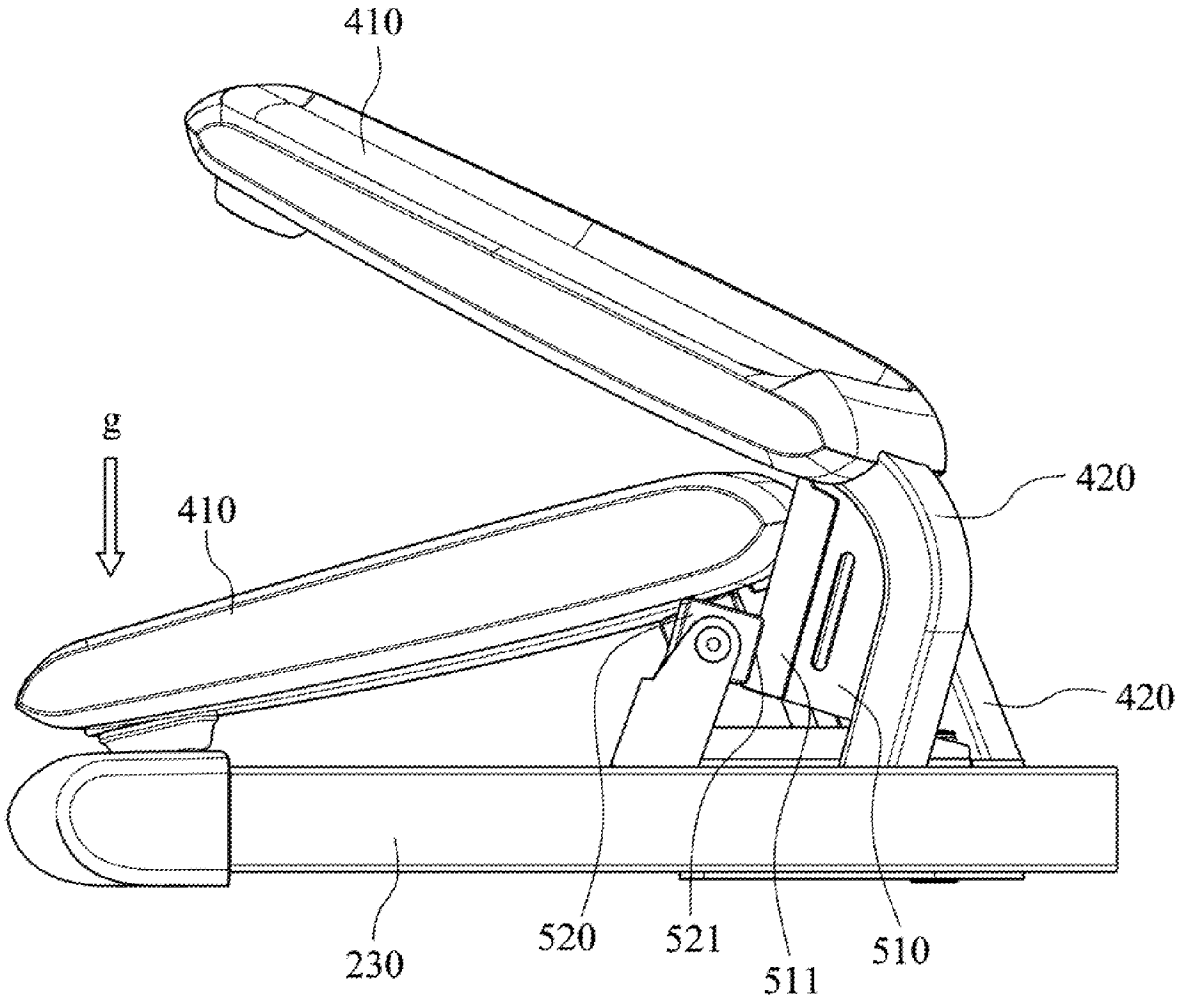
FIG. 4C is a schematic view showing an action of the other side of the stepper of FIG. 4A.

FIG. 4A is a schematic view showing an action of the stepper 100 of FIG. 2; FIG. 4B is a schematic view showing an action of one side of the stepper 100 of FIG. 4A; FIG. 4C is a schematic view showing an action of the other side of the stepper 100 of FIG. 4A.

When the pedal 400 is lowered along a gravity direction g, the first blocking surface 511 of the blocking member 510 disposed on the pedal 400 and the second blocking surface 521 of the blocking block 520 are inclined along the gravity direction, thereby concentrically rotating the two ends 310 of the linking rod 300. At the time, the first blocking surface 511 of the other blocking member 510 is rotatably resisted by the second blocking surface 521 of the other blocking block 520, thereby raising the other pedal 400. Therefore, the left pedal 400 or the right pedal 400 can swing up and down through concentrically rotating the linking rod 300 and the resisting between the blocking member 510 and the blocking block 520.

Figure 5A:
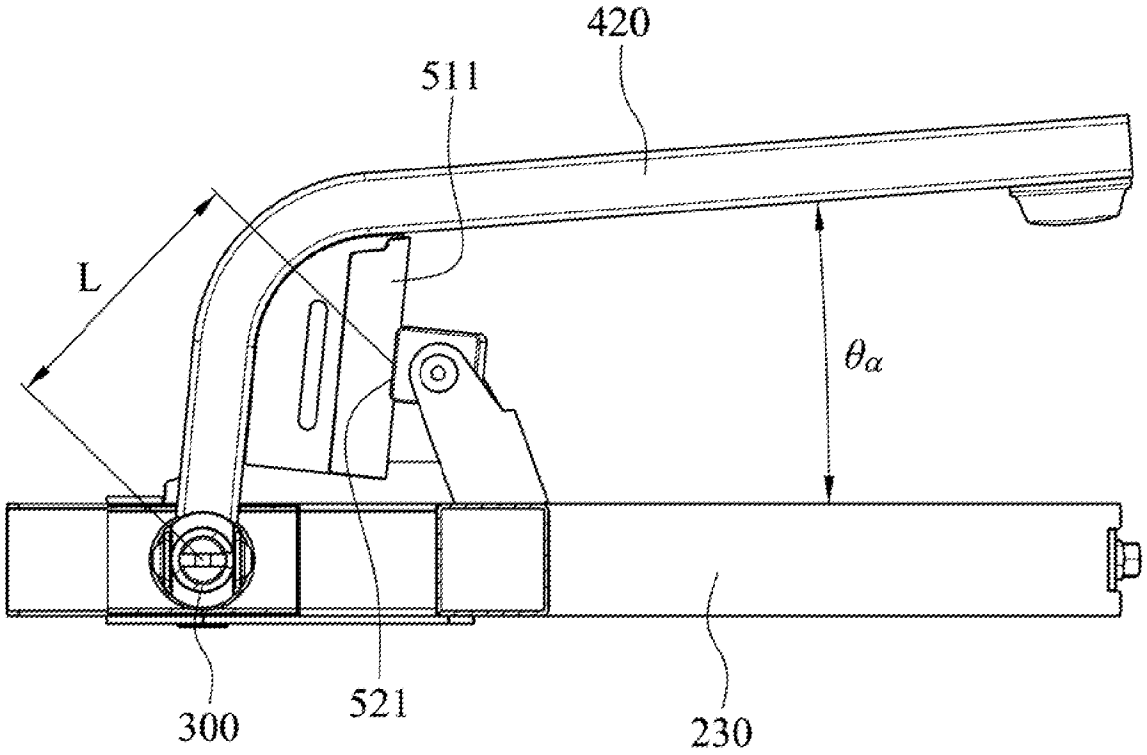
FIG. 5A is a schematic view showing a pre-determined distance formed between the blocking block and linking rod and an up-down swing angle at the pedal arm of the stepper of FIG. 2.
Figure 5B:
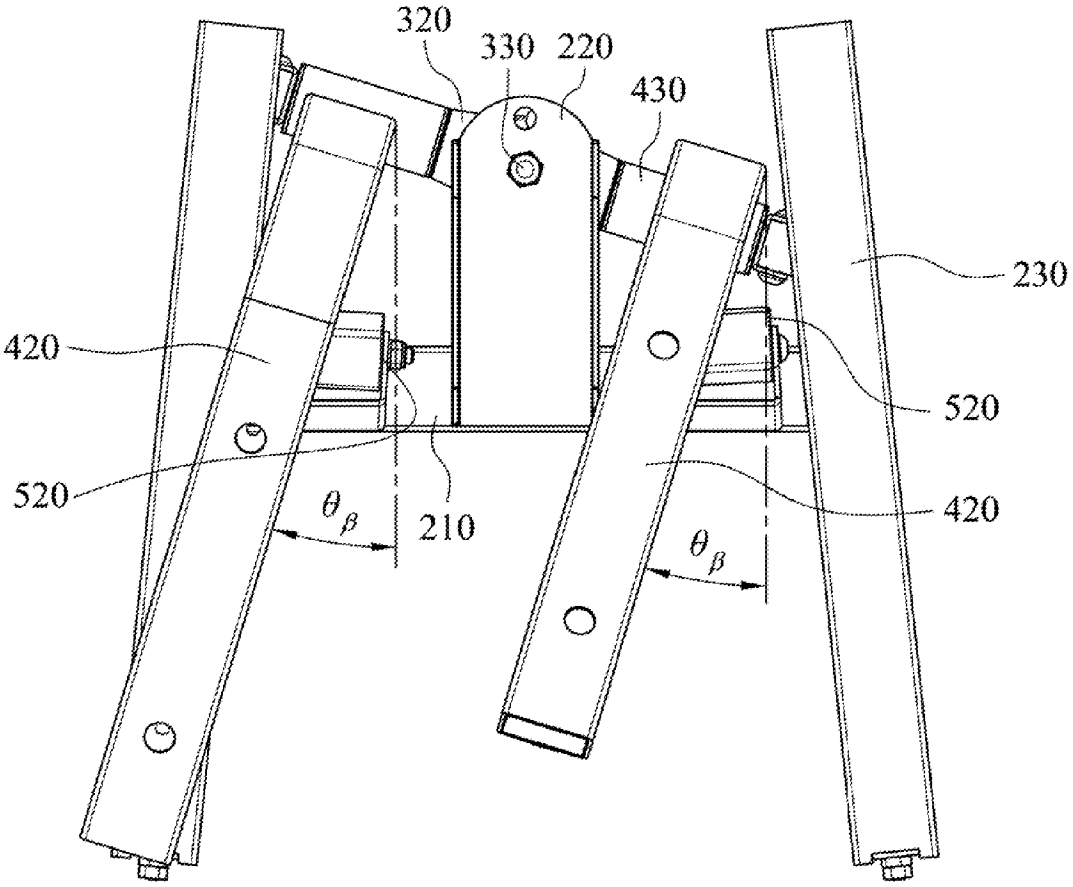
FIG. 5B is a schematic view showing a left-right swing angle of the pedal arm of the stepper of FIG. 2.

However, it should be mentioned that the pedal 400 of the stepper 100 is linked-up by the blocking block 520 and the blocking member 510, thus it can swing up-down and left-right simultaneously. Referring to FIG. 2 and FIGS. 5A to 5B. FIG. 5A is a schematic view showing a pre-determined distance L formed between the blocking block 520 and finking rod 300 and an up-down swing angle $\theta_\alpha$ of the pedal arm 420 of the stepper 100 of FIG. 2; and FIG. 5B is a schematic view showing a left-right swing angle $\theta_\beta$ the pedal arm 420 of the stepper 100 of FIG. 2.

Since the blocking member 510 on the pedal arm 420 is always resisted by the blocking block 520 no matter the pedal arm 420 swings up or down, and the linking rod 300 is rotated around a circle center, the pedal arm 420 can not only swing up and down, but also can swing left and right b the linking rod 300. Assuming that the height of the pedal arm 420 and the height of the blocking block 520 are fixed, the up-down swing angle $\theta_\alpha$ and the left-right swing angle $\theta_\beta$ of the pedal arm 420 will become smaller when the pre-determined distance L between the blocking block 520 and the linking rod 300 becomes larger. Therefore, the user can adjust pedal stroke and the swing angle by adjusting the position of the blocking block 520. Furthermore, in the embodiment, the blocking block 520 includes four second blocking surfaces 521. When the four second blocking surfaces 521 include different contacting areas, the up-down swing angle $\theta_\alpha$ and the left-right swing angle $\theta_\beta$ of the pedal arm 420 can also be adjusted.

Figure 6:
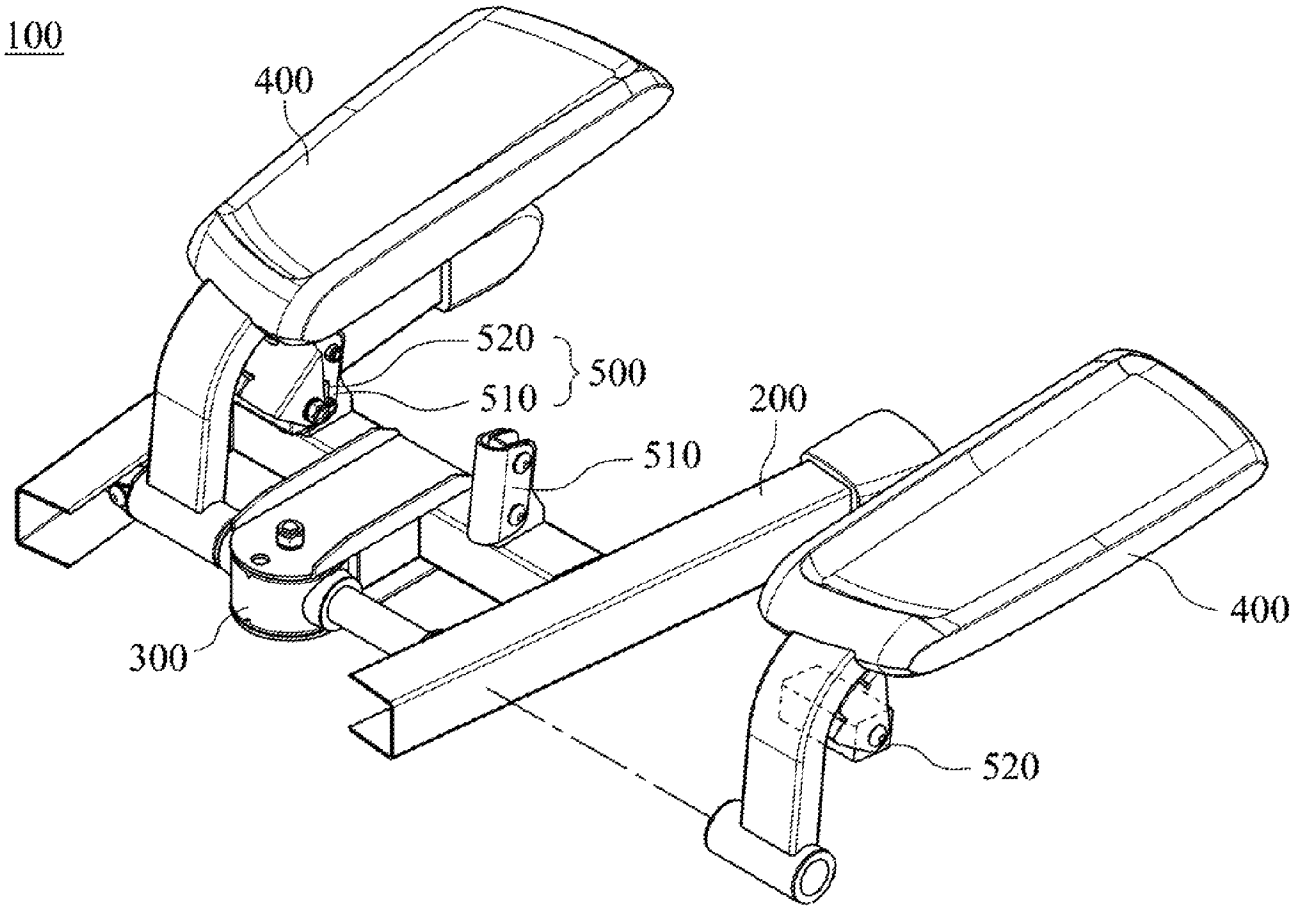
FIG. 6 is a schematic view showing a stepper according to one embodiment of the present disclosure.
Figure 7:
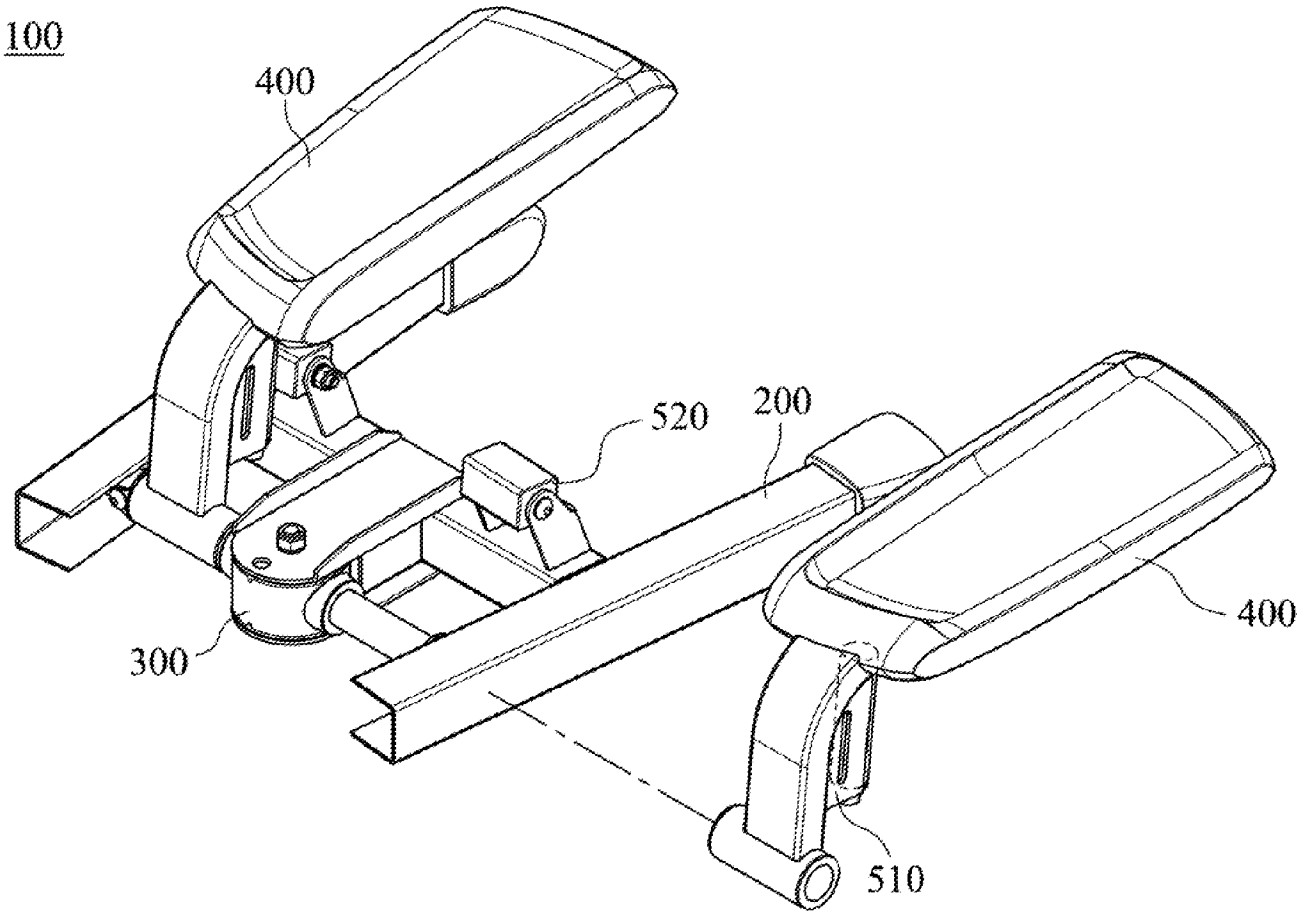
FIG. 7 is a schematic view showing a stepper according to one embodiment of the present disclosure.
Figure 8:
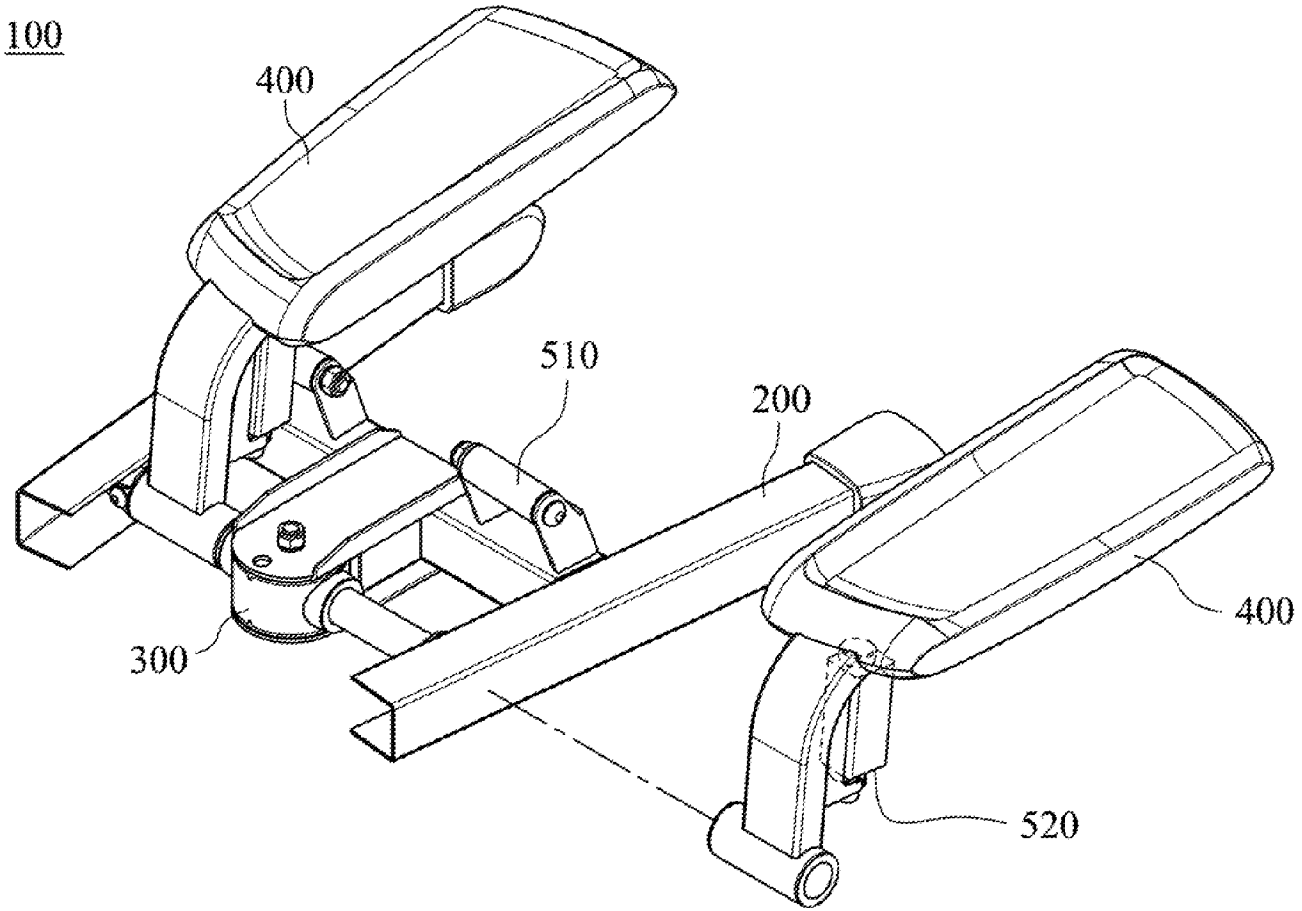
FIG. 8 is a schematic view showing to stepper according to one embodiment of the present disclosure.

FIG. 6 is a schematic view showing a stepper 100 according to one embodiment of the present disclosure; FIG. 7 is a schematic view showing a stepper 100 according to one embodiment of the present disclosure; and FIG. 8 is a schematic view showing a stepper 100 according to one embodiment of the present disclosure.

In FIG. 6, the positions of the blocking block 520 and the blocking member 510 are not limited. As long as the relative position of the blocking block 520 and the blocking member 510 are not changed, the position of the blocking block 520 and the blocking member 510 can be exchanged for adjusting the pedal stroke (up-down swing angle $\theta_\alpha$) and the left-right swing angle $\theta_\beta$. In FIG. 7, the blocking member 510 includes a rotatable circle surface, thus the stamping of the pedal 400 can be smoother. In FIG. 8, it is shown that the positions of the blocking block 520 and the blocking member 510 are exchangeable.

Figure 9:
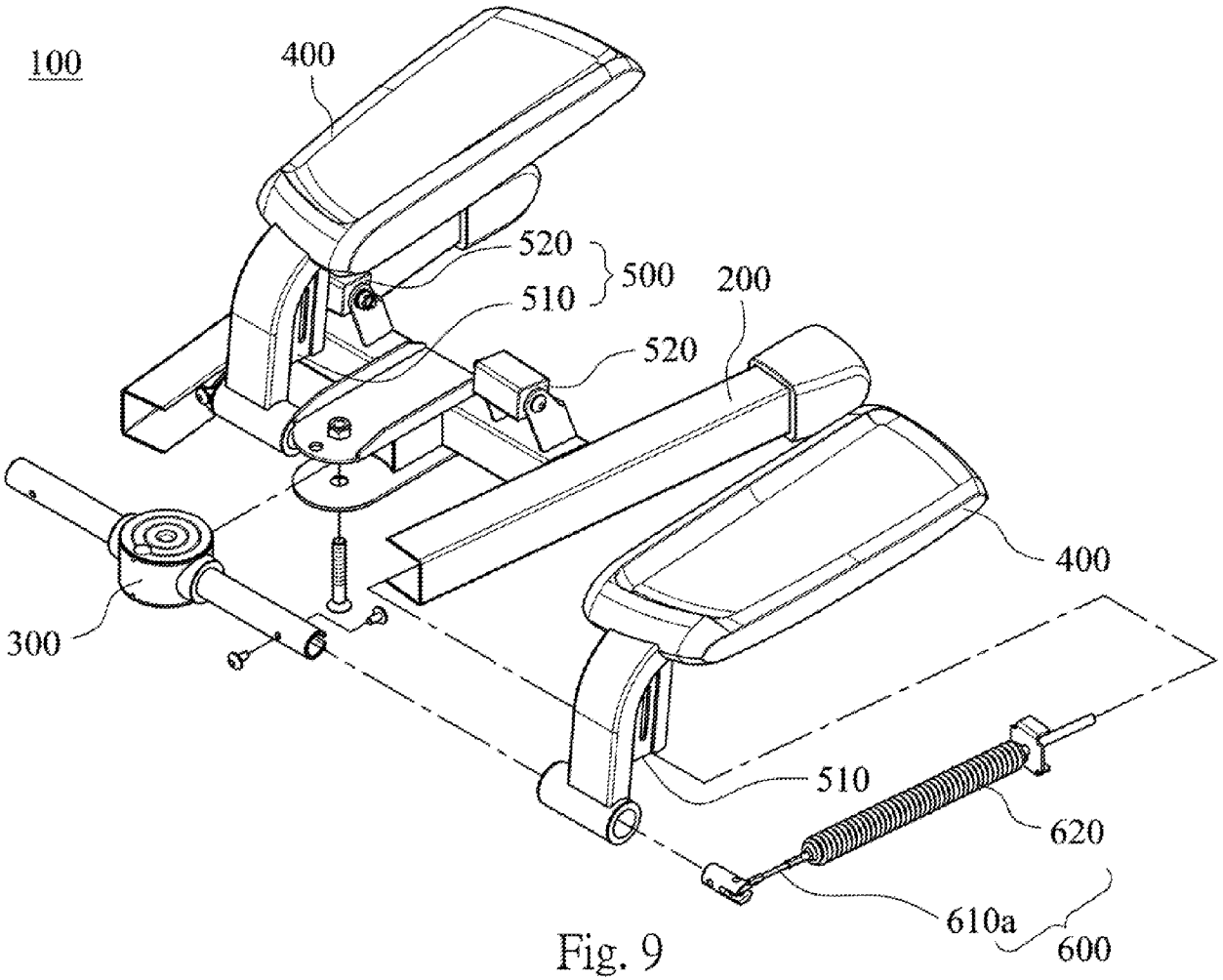
FIG. 9 is an exploded view showing a stepper according to one embodiment of the present disclosure.
Figure 10:
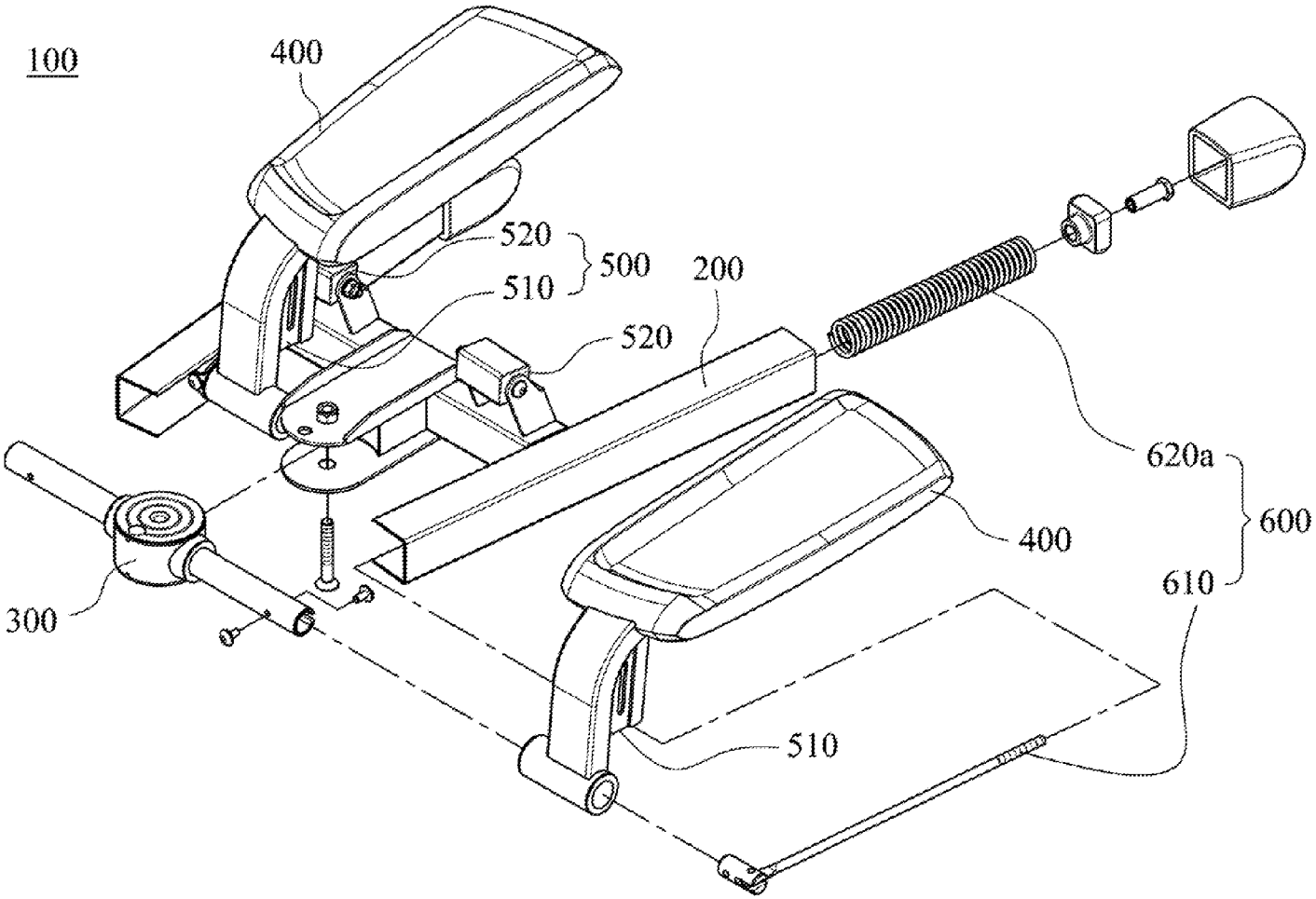
FIG. 10 is an exploded view showing a stepper according to one embodiment of the present disclosure.
Figure 11:
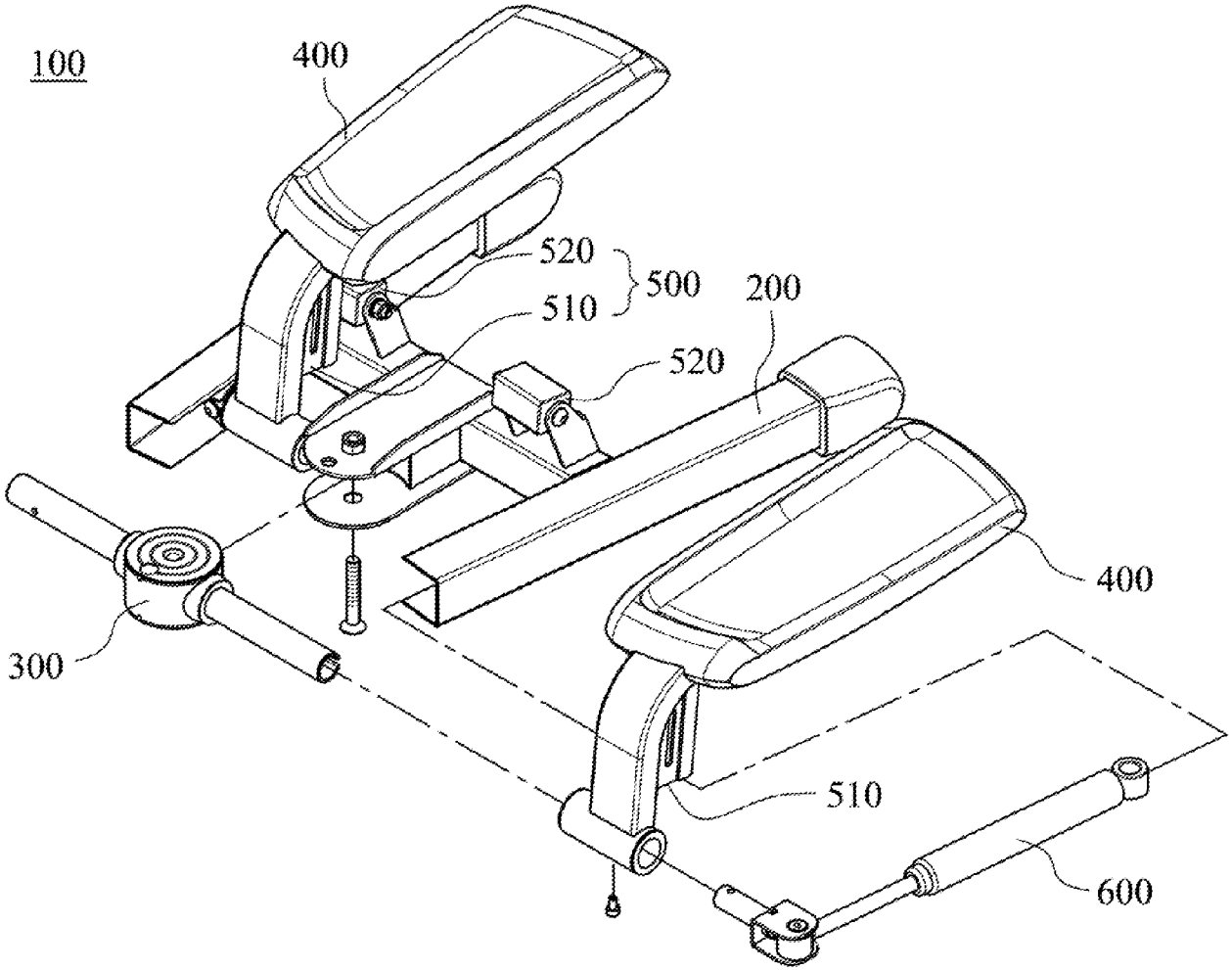
FIG. 11 is an exploded view showing a stepper according, to one embodiment of the present disclosure.

FIG. 9 is an exploded view showing a stepper 100 according to one embodiment of the present disclosure; FIG. 10 is an exploded view showing a stepper 100 according to one embodiment of the present disclosure; and FIG. 11 is an exploded view showing a stepper 100 according to one embodiment of the present disclosure.

In FIG. 9, the recovering mechanism 600 provides a recovering force by combining a steel rope 610*a* and a tension spring 620. In FIG. 10, the recovering mechanism 600 provides a recovering force by combining a connecting lever 610 and a compression spring 620*a*. In FIG. 11, the recovering mechanism 600 provides a recovering force by a pneumatic cylinder or an oil cylinder. Therefore, the recovering mechanism 600 can have various structures for providing the recovering force.

In sum up, the stepper of the present disclosure has advantages on:

(a) Reciprocately stamping functionalities can be achieved by the simple structure of the linking rod and the adjusting mechanism.

(b) To the up-down swing of the pedal, the structure of the linking rod and the adjusting mechanism of the present disclosure are more stable than the conventional linking structure utilizing lever principle or V-type swing.

(c) The pedal can swing up, down, left and right by incorporating the linking rod the inclined direction of the blocking member and the blocking block.

(d) The pedal stroke and the swing angle can be adjusted by exchanging the position of the blocking block and the blocking member, changing the number of the first blocking surface and the second blocking, surface, or changing the contacting area of the second blocking surface of the blocking block.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A stepper, comprising:

a base;

a linking rod disposed on the base, wherein the linking rod comprises two ends that are concentrically rotated with each other;

two pedals, each of the pedals comprising:

a pedal member; and a pedal arm connected to the pedal member, wherein the pedal arm is L-shaped and pivotally connected with one end of the linking rod for reciprocately raising or lowering the pedal member; and two adjusting mechanisms, each of the adjusting mechanisms comprising:

a blocking member disposed in a corner of the pedal arm, the blocking member comprising a curved surface against the corner of the pedal arm and a first blocking surface;

a blocking block being apart from the linking rod by a pre-determined distance, the blocking block comprising a second blocking surface resisting the first blocking surface of the blocking member;

wherein when one of the pedals is lowered along a gravity direction, one of the first blocking surfaces and one of the second blocking surfaces are inclined relative to the gravity direction to correspondingly move one end of the linking rod thereby concentrically rotating the other end of the linking rod, and the first blocking surface of the other blocking member is resisted by the second blocking surface of the other blocking block, thereby swinging and raising the other one of the pedals, wherein each second blocking surface reciprocately slides on a respective first blocking surface of one blocking block along with a respective pedal member being raised and lowered.

2. The stepper of claim 1, further comprising two recovering mechanisms, wherein each of the recovering mechanisms is connected with one of the ends of the linking rod and the base, wherein each of the recovering mechanism comprises a connecting lever and a tension spring, one end of the connecting lever is connected to one of the ends of the linking rod, and another end of the connecting lever is connected to the tension spring.

3. The stepper of claim 2, wherein, the base comprises:

a central portion configured for locating the two blocking blocks;

an extension portion extended vertically and outwardly from the central portion; and two side portions connected to two ends of the central portion, wherein the two side portions are arranged in a shape of splayed arch, and the two side portions are hollow for locating the two recovering mechanisms;

the linking rod comprises a circle-center portion located in a center of the linking rod, and the circle-center portion is pivotally connected to an outer end of the extension portion to rotate the linking rod; and each of the pedals comprises a pivoting portion, each of the pivoting portion is integrally connected to each of the pedal arms and is pivotally connected to the two ends of the linking rod, thereby rotating each of the pedal arms relative to the linking rod.

4. The stepper of claim 1, wherein each first blocking surface rotatably resists a respective second blocking surface of one blocking block.

5. The stepper of claim 1, wherein each of the blocking blocks is pivotally disposed on the base, and each second blocking surface rotatably resists the respective first blocking surface of one blocking member.

6. The stepper of claim 1, wherein each blocking block comprises a plurality of said second blocking surfaces.

7. The stepper of claim 6, wherein the second blocking surfaces comprise different contacting areas.

8. The stepper of claim 1, wherein each blocking member comprises a plurality of said first blocking surfaces.

9. The stepper of claim 8, wherein the first blocking surfaces comprise different contacting areas.

10. The stepper of claim 1, wherein the first blocking surface is made from elastic material.

11. The stepper of claim 1, wherein the second blocking surface is made from elastic material.

* * * * *